US005590546A

United States Patent [19]

Hector

[11] Patent Number: 5,590,546

[45] Date of Patent: Jan. 7, 1997

[54] JEWELRY BEADS INCLUDING MAIN BEADS MADE UP OF SMALL BEADS

[76] Inventor: Valerie Hector, 2064 N. Leavitt, Chicago, Ill. 60647

[21] Appl. No.: 360,163

[22] Filed: Dec. 20, 1994

[51] Int. Cl.[6] ..... A44C 25/00

[52] U.S. Cl. ..... 63/2

[58] Field of Search ..... 63/2, 3; 29/160.6

[56] References Cited

U.S. PATENT DOCUMENTS

| | | | |
|---|---|---|---|
| 921,759 | 5/1909 | Walker | 63/3 |
| 1,927,038 | 9/1933 | Kane | 63/2 |
| 1,943,658 | 1/1934 | Dyckma | 63/26 |
| 2,033,944 | 3/1936 | Lely | 63/2 |
| 2,332,344 | 10/1943 | Roskin | 63/15 |
| 3,667,098 | 6/1972 | Levy | 63/2 |
| 3,765,376 | 10/1973 | Higgins | 63/2 |

*Primary Examiner*—Flemming Saether
*Attorney, Agent, or Firm*—Paul H. Gallagher

[57] ABSTRACT

Main beads for stringing, each including a rigid central armature, and a string of small beads wrapped thereon, and secured thereto. The small beads provide most of the decorative effect of the main bead. End caps of resin are formed on the ends of the armature. Resin is also used in certain cases in securing the small beads to the armature. Color is used in certain cases, on the armature, which shows through the resin and the small beads. The small beads are arranged in selectively different patterns. One form of device includes an arrangement constituting a brooch.

10 Claims, 3 Drawing Sheets

JEWELRY BEADS INCLUDING MAIN BEADS MADE UP OF SMALL BEADS

BACKGROUND OF THE INVENTION

1. Field of the Invention

The invention resides in the field of jewelry beads such as are ordinarily used to make up necklaces and bracelets, and as individual pieces used as brooches and pins.

2. There is No Known Prior Art

SUMMARY OF THE INVENTION

The invention covers decorative main beads, an individual one of which includes a structural base, and small beads strung together and wrapped or mounted on an armature, to produce an unusual effect and appearance.

The main beads are well adapted to the use of small beads of a vast variety of sizes, shapes and colors, and placed in a wide variety of arrangements, to correspondingly produce the main beads in a wide variety of sizes, shapes and colors. The beads are well adapted to custom design.

The resulting beads can be strung to form necklaces or bracelets, or used as individual brooches or pins. In the case of a necklace or bracelet, it can be made up of a combination of beads of widely different kinds to produce unusual effects.

BRIEF DESCRIPTION OF THE INDIVIDUAL FIGURES OF THE DRAWINGS

Figure 16:
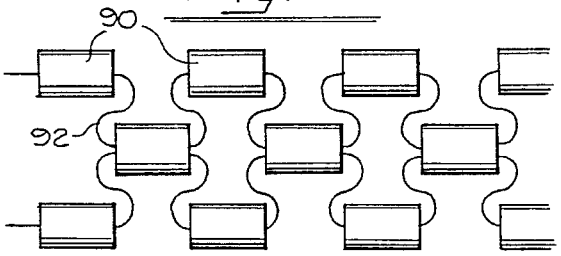

FIG. 16 diagrammatically shows a step in making a peyote stitch or weave.

Figure 17:
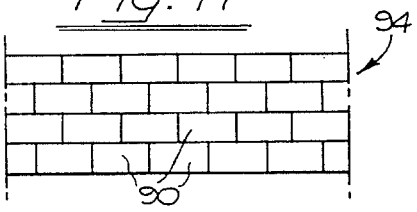

FIG. 17 shows a panel made up of the peyote stitch of FIG. 16, to be wrapped on an armature.

Figure 18:
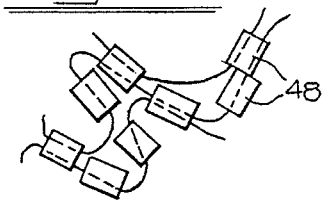

FIG. 18 diagrammatically shows a step in forming a herringbone stitch of small beads.

Figure 19:
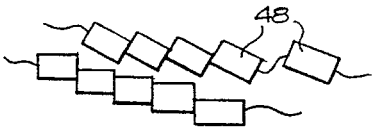

FIG. 19 shows the herringbone stitch completed, in form to be applied to an armature to form a main bead.

Figure 20:
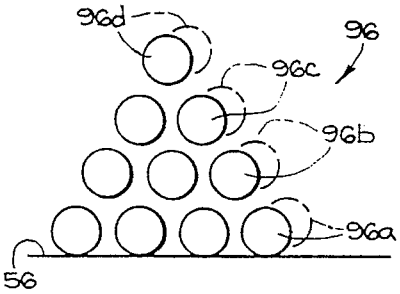

FIG. 20 is a diagrammatic view of a plurality of layers of small beads, arranged to form a disc.

Figure 21:
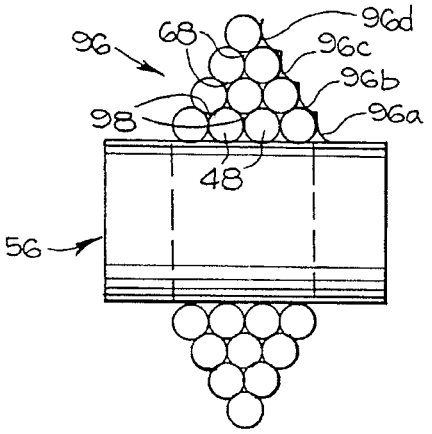

FIG. 21 is a view, in radial direction, of a main bead having a disc formed according to FIG. 20.

Figure 22:
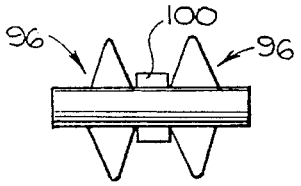

FIG. 22 is a diagrammatic view of a bead having a pair of discs.

Figure 23:
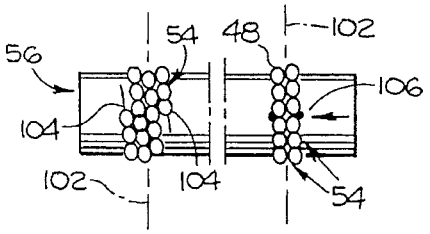

FIG. 23 is a semi-diagrammatic view, from the side of a bead, showing small beads in two different arrangements.

Figure 24:
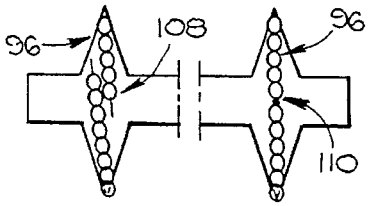

FIG. 24 is a semi-diagrammatic view of two discs having different detail arrangement of small beads.

Figure 25:
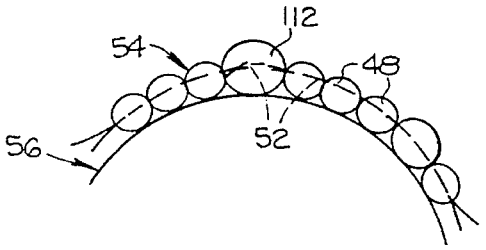

FIG. 25 is a fragmentary view of small beads which include eyeball beads.

Figure 26:
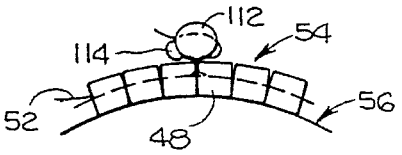

FIG. 26 is a view similar to FIG. 25 but showing a peyote stitch with eyeball beads therein.

Figure 27:
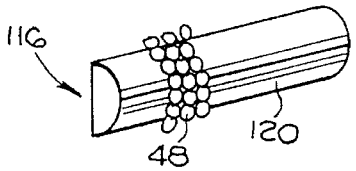

FIG. 27 is a partial view of a brooch made in a manner similar to that of the beads.

Figure 28:
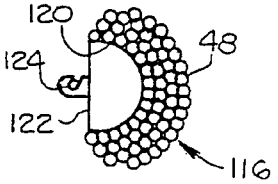

FIG. 28 is an end view of the brooch of FIG. 27.

Figure 29:
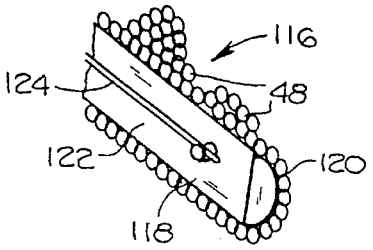

FIG. 29 is a fragmentary perspective view from an angle opposite that of FIG. 27.

DETAILED DESCRIPTION OF THE DRAWINGS

Figure 1:
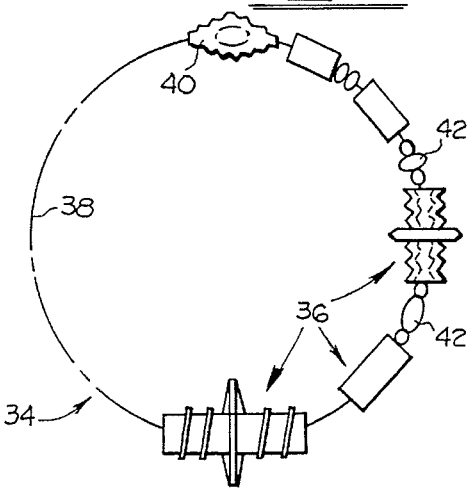
FIG. 1 is semi-diagrammatic view of a necklace including beads made according to the present invention.
Figure 3:
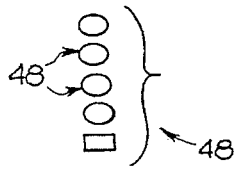
FIG. 3 shows seed beads constituting one form of small beads.
Figure 4:
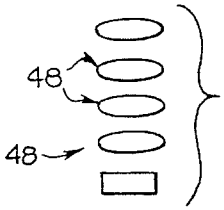
FIG. 4 shows another form of small beads.

FIG. 1 shows a necklace identified in its entirety at 34 which incorporates a plurality of beads 36 that are made according to the present invention. For purposes of convenience, these beads 36 will be referred to at times as main beads. They are strung on a stringing thread 38 the ends of which are secured to a clasp 40. The necklace may include a plurality of spacer beads 42 between the main beads, these spacer beads being of any desired type and do not enter into the present invention. The inventive features reside in the main beads.

Figure 2:
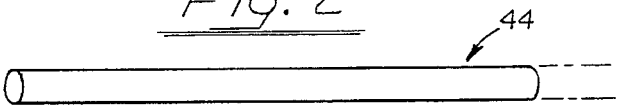
FIG. 2 shows a dowel rod used in making the beads.

In constructing the main beads 36, a dowel rod 44 (FIG. 2) is utilized, which is of indeterminate length, suitable for handling; at a later stage, in the making of the beads, it is cut into segments which are referred to as armatures.

Figure 5:
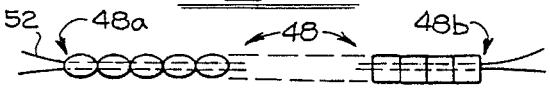
FIG. 5 is a fragmentary string of seed beads of different kinds.

In the making up of the main beads, each individual main bead includes what may be referred to generically as small beads (FIGS. 3, 4, 13, 14); small beads include two different kinds, namely seed beads and bugle beads. The seed beads are shown at 48 and the bugle beads at 50. The seed beads have a length similar to their diameter, but not necessarily exactly so, and as shown in FIG. 5, may have round ends as at 48*a* or square ends as at 48*b*. The bugle bead 50 are of a length considerably greater than their diameter and have generally square ends. Both have holes therethrough for stringing them.

In FIG. 5 the beads 48 are strung on a constructional thread 52 forming a string 54. This thread may consist of a single filament or strand, or two filaments, usually the latter, for use in securing the small beads to the dowel.

Figure 6:
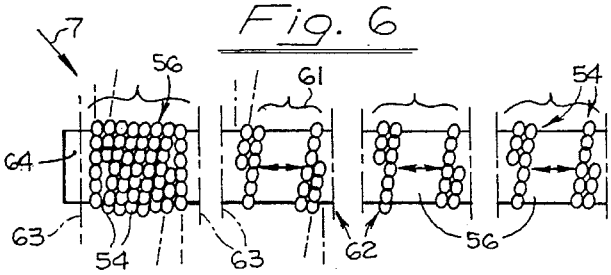
FIG. 6 is a dowel rod after being cut in sections, with strings of small beads wrapped thereon, to form main beads.

In a next step in forming a main bead, the string 54 of small beads, in one form of the item, is applied to the dowel by wrapping it thereon, such as in a spiral or helical shape as indicated in FIG. 6. This string 54 is of selected length that upon wrapping it on the dowel rod, it extends along the rod a predetermined extent, according to the desired character and length of the main bead to be produced. In the selected illustration, that string (54) after being wrapped, extends throughout a length of the rod indicated at 56. The details of securing the strings 54 to the rod may vary; the beginning end may be tied to the rod, and if desired the terminal end so tied also. Whether so tied or not, resin is applied at the ends to hold the string in palce, and in the case of the spiral winding, the resin is also applied over the string, that is, over the beads the full length of the string. However, there are often arrangements in which the resin is not applied over the beads as will be described below.

Figure 7:
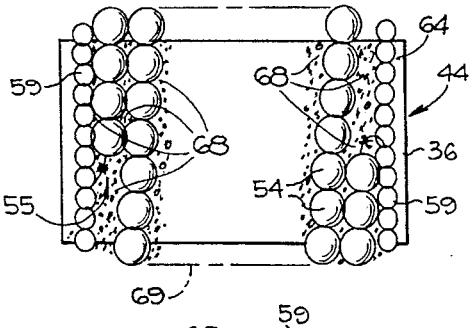
FIG. 7 is a large scale view of a segment of the dowel rod of FIG. 6 indicated by the arrow 7.

An end element 59 (FIG. 7), which is in the form of a ring of small beads, is applied to each end of the wound string 54.

These end elements may be formed separate from the strings 54, and are secured to the rod as by tying. It is within the scope of the invention that this end element be formed as a continuation of the string 54, as shown at 55 in FIG. 7. The beads in the end element are different from those in the strings 54 for decorative purposes.

Then another string 54 is wrapped on the dowel rod, at a location spaced from the first one, as indicated at 61, and completed in the same manner as in the case of the first segment. Thereafter, additional strings 54 are wrapped on the rod according to the number of main beads 36 to be made.

Each string 54, so wrapped on the rod forms the basis of a main bead or basic member, identified 62 (FIG. 6). Then the rod is cut to separate the individual basic members, which may be done as the finishing steps proceed, or at one time. At each basic member are lines 63 where the rod is cut. Preferably the cutting is made closely adjacent the beads. The length of the rod so cut off is known as an armature, identified 64. Then a hole 65 is drilled longitudinally through the armature, and the end of armature sanded and/or polished. Following that step, the ends are painted.

The strings 54 in FIGS. 6–9 are represented only diagrammatically, the small beads in the various main beads being of different character, size and shape, etc., and strung in specifically different forms, as will be described in detail hereinbelow.

In making the main beads, resin is used both to solidify the small beads in position, and for providing decorative features. An example of resin used, is a 2-ton epoxy resin which is a two-part resin, bearing the brand name Devcon. This material is initially in liquid, or near-liquid form, and it cures and hardens after a period of time, when exposed to the atmosphere. For convenience herein, and particularly in interpreting the claims, this resin may be identified as fluid, in its initial stages, in that it flows, and after a period of time, it becomes more viscous and does not flow. It also functions as an adhesive material and may be referred as such.

The resin, now identified 68 (FIG. 7), is applied, as stated above, to the beads 48 making up the strings, for holding them in place, the resin being applied the full length of the armature as indicated at 69. This is particularly true in the case where the string 54 is wound spirally.

Figure 8:
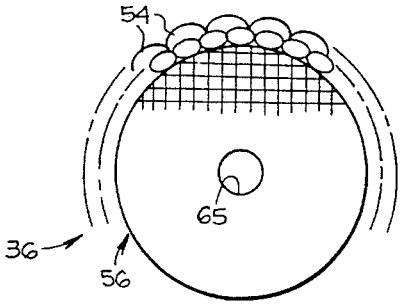
FIG. 8 is an end view of the segment of FIG. 7.
Figure 9:
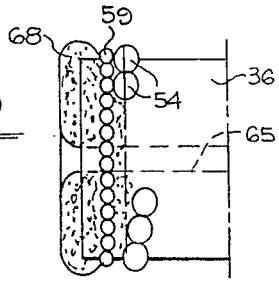
FIG. 9 shows the left end portion of the bead of FIG. 7 with resin applied thereto.
Figure 10:
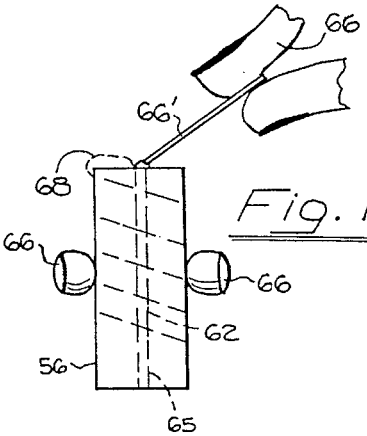
FIG. 10 shows a bead in position for applying resin thereto.
Figure 11:
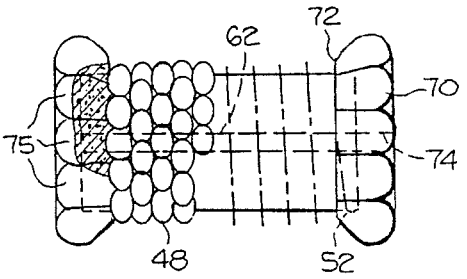
FIG. 11 shows resin over the small beads to form an end decoration of the main bead.

A main bead 36 as represented in FIGS. 8 or 9, may be considered structurally complete, but it is desired to provide a more decorative effect. The bead is held in a suitable manner, as by the fingers as shown at 66 (FIG. 10) and the maker (at 66) utilizes an instrument, such as a pin stem held by the fingers 66', and takes drops of the resin from an aggregate supply and applies the resin to the end of the armature. This resin, is applied to the end of the armature in any desired quantity, to provide a thickness in axial direction as desired. At this stage, the resin is of course fluid, but as it becomes less fluid, it can be applied to any desired thickness, and any shape within a wide range, to form an end cap. In FIGS. 10, 11 such an end cap is identified at 70 and FIG. 11 indicates the possible dimensions thereof. It may be of considerable thickness in axial direction, and it extends axially along the armature to a significant extent as indicated at 72 for solidifying it on the armature. In the case where the end elements 59 are included (FIG. 9), the resin is applied in such quantity as to only reach the beads in the end rings, and not extend over them, to leave them exposed as a decoration. However, the resin at the ends may actually extend over the ends of the beads (48) and be of relatively great dimensions and in itself form an "end cap" and constitute a decoration. The resin may also be used for gripping and holding the ends of the constructional thread 52, at the very ends of the armature. In this application of the resin, in the form represented in FIG. 11, the resin is not applied over the small beads 48, the latter being fully exposed for full view. In applying the resin to form the end cap 70 care is taken to leave a hole 74 (FIG. 11) therein in line with the hole 65 through the armature, for receiving the constructional thread 52, or this hole (65) may be formed later. This end cap may be plain, but if desired, a decorative feature may be included in it, such as the globular elements 75 to blend with the small beads. The end caps also serve the purpose of forming stops or abutments to solidify or hold the small beads in axial direction.

The resin 68 is clear, and the base color, or the color under the resin, shows through very prominently to the exterior, to the observer. The dowel rod 44 is preferably of wood, although it may be made of other materials. As wood, the rod may be considered as of neutral color, the color not passing through the resin to any significant extent. However, in certain cases, it is desired to provide color showing through the beads, and through the resin, and for this purpose the armature 56 (FIG. 12) may be painted certain colors. The neutral color (of wood) is indicated by lining 76 conventionally indicating yellow/gold. The end surface may be painted black as indicated at 78, and when the resin 68 is applied to the armature, the black color shows through prominently. Another black band is indicated at 80, a red band at 82 and a white painted band at 84. For producing these colors, preferably acrylic paint is utilized. In the various forms of the main beads 36, described hereinbelow, these colors may be provided selectively, for producing a corresponding effect through the small beads.

Figure 13:
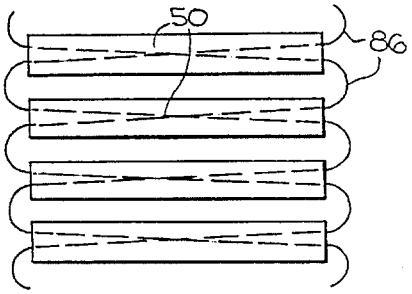
FIG. 13 is a fragmentary string of bugle beads in a ladder stitch.
Figure 14:
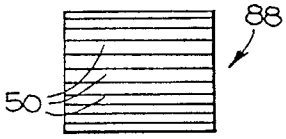
FIG. 14 is a panel formed by the bugle beads of FIG. 13.
Figure 15:
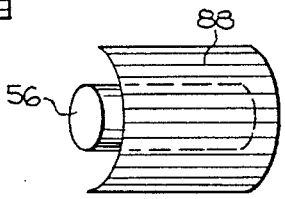
FIG. 15 shows the panel of FIG. 14 in a step of being applied to the armature.

In the foregoing, the small beads were constituted by seed beads 48 (FIG. 3) and attention is now directed to FIGS. 13–15 showing small beads constituted by bugle beads woven in a ladder stitch. In FIG. 13, a series of bugle beads 50 are shown, with constructional thread 86 threaded therethrough, the bugle beads being arranged adjacent each other with their axes parallel. A desired number of the beads are so strung together, in a panel 88 (FIG. 14), and the string tied to form a self-contained panel. This panel which is quite evenly rectangular in shape is then wrapped (FIG. 15) on an armature 56 and tied, forming a ladder stitch. The bugle beads are of such selected length, according to the desired length of main bead as determined by the armature, or vice versa, the armature is cut to length according to the length of the bugle beads. In this case, the bead may be provided with a resin end cap 70 as in the form described above, and as represented in FIG. 11. It will be noted that the plastic does not extend over the ends of the beads.

FIGS. 16, 17 show another arrangement of small beads, in a known form identified as a peyote stitch. In this arrangement, a number of seed beads 90 are strung on threads 92 in a manner represented in FIG. 16 and when they are all so strung and the constructional threads drawn up tight, the seed beads fall into a pattern represented in FIG. 17 where they are relatively staggered in adjacent rows. In this construction also, the resulting peyote strung beads are formed into a rectangular panel 94 of the desired dimensions, and applied to an armature as represented in FIG. 15. In this case also the threads of the panel 94 are tied on the armature, which secures the panel thereto. FIGS. 18 and 19, as noted, show a herringbone stitch.

In both forms represented in FIGS. 13–15, and 16–17, no resin is used in securing the small beads to the armature; in these cases, the small beads are arranged in mutual engagement throughout the area of the panels, effectively and completely covering the surface of the armature, and the small beads provide the visual appearance that is to be the main bead, this being separate from the effect of the end caps, which may be colored.

FIGS. 20 and 21 show a form identified as a disc 96. To form the disc a plurality of layers 96*a*, 96*b*, 96*c*, 96*d*, are applied to the armature 56. In this case the beads are seed beads preferably round as at 48*a*, or roundish; in the first layer 96*a* there are four strings wrapped on the armature adjacent each other. Between adjacent beads are crevices 98, such crevices appearing in each of the layers except the top layer. The beads of the second layer 96*b* are placed in the crevices of the first layer, those of the third layer are put in the crevices of the second layer and finally, the beads of the fourth layer are put in the crevice of the third layer. The layers being of successively lesser number of strings of beads, form a V-shape, and thus the outer surfaces converge radially outwardly, and form a disc in shape. In the process of applying the beads, resin 68 is applied throughout the stack, and it hardens, and together with the small beads forms a solid mass, constituting the disc. FIG. 20 shows diagrammatically how the beads are placed in the corresponding crevices. Resin is then applied to the ends of the main bead, as shown in FIG. 10, which forms end caps, or decorative elements.

While FIGS. 20 and 21 show a single disc 96, the bead may be made with a plurality of discs, shown diagrammatically in FIG. 22, each being a complete disc, and the discs spaced apart by a bead component 100 of any form, including any of the those disclosed herein.

The strings constituting single rows of seed beads, such as 54 in FIG. 5, may be applied to the armature in different ways, as represented in FIG. 23 which shows the elements semi-diagrammatically. In this figure, an armature 56 is shown where at the left is a single string 54 wound in spiral shape, in the manner described above, showing its angular relation to the diametrical line 102. At the right separate strings 54 are wound individually, and in planes perpendicular to the axis, as indicated by the diametrical line 102. In this case the ends of the construction thread 52, in each string, are tied as indicated at 106. These components as made up in FIG. 23 are representative, and may be incorporated in main beads having various different kinds of strings.

FIG. 24 shows arrangements of strings as described in connection with FIG. 23, making up discs 96. In this figure, at the left, the strings making up the layers are laid in spiral or helical form as indicated at 108, each of the layers being in that form. However another form is represented at the right in FIG. 24 where the strings of seed beads are arranged in direct transverse direction, each string lying in a plane perpendicular to the axis of the armature. In this case the strings of seed beads are tied at their ends as indicated at 110. Resin is applied in these forms, of FIGS. 20–24, for firmly securing the beads in position.

FIG. 25 shows another form of main bead construction that includes eyeball beads. In this case a string 54 is utilized, including a series, and majority, of seed beads 48, and at intervals, eyeball beads 112. These eyeball beads 112 are preferably larger than the seed beads and stand out visually in the finalized item. These eyeball beads may be of different material from the other beads, such as being made of metal. In this case the string is brought into tight engagement with the armature in wrapping it thereon, and all of the beads engage the armature and the eyeball beads stand out prominently, in radial direction. In FIG. 25 the construction thread 52 is shown in dotted lines, where it is seen that it rises to a greater radial extent passing through the eyeball beads. FIG. 26 shows another form of arrangement including eyeball beads. In this case a string 54 made up mainly of seed beads 48, strung on the thread 52, and at intervals in the string, eyeball beads 112 are interposed. In this case however, the seed beads engage each other, along the line, and the eyeball beads are positioned radially outwardly of the line, making them more prominent. The strand 52 may be reverse-turned as indicated at 114 through the eyeball bead, to hold the assembly in more firm position.

FIGS. 27–29 show the features of the invention incorporated in a brooch 116. In this case the armature 118 may be formed as a split half of a dowel rod, having a curved surface 120 and a plane surface or flat surface 122. On the curved surface 120 are strings of seed beads, applied thereto and secured by resin, as described in connection with FIGS. 20, 21. In this case they are applied only to the curved surface, not the plane surface, the strings of the seed beads terminating in the plane of the surface 122, being held in position by resin. On the plane surface in this instance, is a pin 124 for pinning the brooch in place. It is also within the scope of the invention that this main bead, without the pin 124, may be set in a metal plate or bezel and selective findings attached to the plate to make it into a brooch, or a necklace component, or a bracelet component. Applying the strings of seed beads to the round surface of the armature, is considered wrapped, in the generic sense of that term, this being of particular significance in interpretation of the claims.

Figure 12:
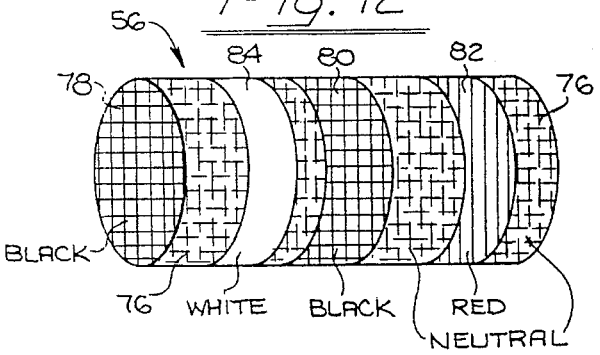
FIG. 12 is a segment of dowel rod, forming an armature, having areas painted different colors.

Various components or parts or elements making up the item may be of different materials, as indicated above. While the armature is preferably of wood, it can be made of other materials, including for example plastic. The small beads in most cases may be of glass, and hence transparent. These also may be made of other materials. When the seed beads are transparent, the colors occurring in the main bead show through, showing easily through the glass beads, as well as through the resin which as referred to above is highly transparent. The small beads may be made of other materials besides glass, including metal, wood, bamboo, as well as other materials. Whether the strings of small beads are tied to the armature, or secured thereto by resin, or both, is somewhat selective, resulting in a wide selection of materials and steps in making up the item. Also utilizing the colors, as in FIG. 12, is also selective. In the case where the small beads and resin are both transparent, the colors may be arbitrarily selected, the colors penetrating through the beads and resin. Also, the small beads themselves may be colored and this coloring produces the desired coloring effect, to the observer, in many cases.

I claim:

1. A main bead for use in a string of beads, comprising, an armature having two ends defining a longitudinal dimension therebetween and a means for receiving said string, at least one strand of small beads wrapped on the armature such that at least two of said small beads are positioned adjacent one another along the longitudinal dimension of the of said armature, the small beads being in a range having ends adjacent the ends of the armature, and epoxy resin adhesive material at the ends of the armature sufficient to hold the small beads on the armature.

2. A main bead according to claim 1 and including, end caps on the ends of the armature, made up of said adhesive material, of large dimensions relative to the armature, forming decorations on the ends of the armature and thereby on the main bead.

3. A main bead according to claim 1 wherein, the adhesive material exists substantially only at the ends of the armature, to the exclusion of a space between the ends of the armature.

4. A main bead according to claim 1 wherein, the resin is transparent and is distributed throughout the longitudinal dimension of the armature, intermixed with the small beads.

5. A main bead according to claim 1 wherein, said at least one strand is arranged in the form of a rectangular panel, the panel is wrapped on the armature, and tied thereto, and substantially completely covers the armature.

6. A main bead according to claim 5 wherein, the small beads occupy a entire area of the panel, with adjacent small beads touching without spaces therebetween, and the small beads are in any one selective pattern of
peyote stitch,
herringbone stitch,
ladder stitch,
in seed or bugle beads.

7. A main bead according to claim 1 wherein, a plurality of said strands are arranged in layers wrapped on the armature and stacked radially outwardly, each of the layers except a radially outermost one including a plurality of strands, and including, a first layer, directly engaging the armature, the strands forming crevices between adjacent strands thereof, and at least a second layer radially outwardly of the first layer and including one of said strands in each crevice in the first layer and disposed therein, and adhesive material embedding all of the layers, and the plurality of layers constituting a disc.

8. A main bead according to claim 7 and including, a plurality of said discs on a single armature positioned independently of juxtaposition to each other.

9. A main bead according to claim 1 wherein.

said one of said strands, strand is selectively one of
spiral wound,
continuous wound.

10. A main bead according to claim 1 wherein, at least one strand includes a series of seed beads including eyeball beads larger than the remaining seed beads, and interspersed therein of highly contrasting visual features including size and color.

* * * * *